US007681785B2

(12) United States Patent
Grigor

(10) Patent No.: US 7,681,785 B2
(45) Date of Patent: Mar. 23, 2010

(54) STACKABLE CORRUGATED BOX

(75) Inventor: Steve Grigor, St. Marys (CA)

(73) Assignee: Cascades Canada Inc., Montreal (Quebec) (CA)

( * ) Notice: Subject to any disclaimer, the term of this patent is extended or adjusted under 35 U.S.C. 154(b) by 0 days.

(21) Appl. No.: 12/323,417

(22) Filed: Nov. 25, 2008

(65) Prior Publication Data

US 2009/0314827 A1 Dec. 24, 2009

(30) Foreign Application Priority Data

Jun. 18, 2008 (CA) ..... 2635275

(51) Int. Cl.
*B65D 21/032* (2006.01)
*B65D 5/22* (2006.01)

(52) U.S. Cl. ..... 229/176; 229/174; 229/178; 229/915; 229/919

(58) Field of Classification Search ..... 229/172, 229/174, 176, 178, 915, 918, 919
See application file for complete search history.

(56) References Cited

U.S. PATENT DOCUMENTS

| | | | | | |
|---|---|---|---|---|---|
| 2,295,141 | A | | 9/1942 | Van Wingen | |
| 2,828,059 | A | * | 3/1958 | Ross | 229/176 |
| 2,934,250 | A | | 4/1960 | Stotz | |
| 3,006,523 | A | * | 10/1961 | Keith | 229/915 |
| 3,114,493 | A | * | 12/1963 | Dunkin | 229/176 |
| 4,134,533 | A | | 1/1979 | Heavner | |
| 4,770,339 | A | | 9/1988 | Weimer | |
| 4,923,113 | A | | 5/1990 | Guijarro | |
| 5,294,044 | A | | 3/1994 | Clark | |
| 5,429,296 | A | | 7/1995 | Southwell et al. | |
| 5,452,848 | A | | 9/1995 | Mur Gimeno | |
| 5,535,941 | A | | 7/1996 | Garza | |
| 5,649,663 | A | | 7/1997 | Pestow, Jr. | |
| 5,860,590 | A | | 1/1999 | Blomfield et al. | |
| 6,296,178 | B1 | * | 10/2001 | McKenna, Sr. | 229/918 |
| 6,508,395 | B2 | * | 1/2003 | McLeod | 229/174 |
| 6,889,893 | B2 | * | 5/2005 | Kent | 229/919 |
| 7,207,473 | B2 | * | 4/2007 | Fry | 229/174 |
| 7,413,111 | B2 | * | 8/2008 | Quaintance et al. | 229/199 |
| 2002/0125308 | A1 | * | 9/2002 | McLeod | 229/174 |

(Continued)

FOREIGN PATENT DOCUMENTS

| | | |
|---|---|---|
| AU | A-61361/90 | 3/1991 |

(Continued)

*Primary Examiner*—Gary E Elkins
(74) *Attorney, Agent, or Firm*—Baker & Hostetler LLP

(57) ABSTRACT

A stackable corrugated box made from a foldable blank comprising a base having two opposed first edges and second edges, wall portions extending from the first edges, side wall portions extending from the second edges. The wall portions comprise a first part connected to the base and a second part connected to the first part, provided with flaps. The first parts include crush and knife cut features capable of flexing outward. When the box is erected, the side wall portions are folded perpendicularly to the base and connected via the flaps to upwardly directed walls defined by the first and second parts also folded perpendicularly to the base. The upwardly directed walls are provided with projecting tabs, so that when the box is stacked on another similar box, the crush and knife cut features flex outward creating space for the tabs from the box placed below.

8 Claims, 8 Drawing Sheets

U.S. PATENT DOCUMENTS

2007/0051789 A1 * 3/2007 Panduro et al. ..... 229/918

FOREIGN PATENT DOCUMENTS

| | | | |
|---|---|---|---|
| CA | 2 217 582 | | 10/1996 |
| DE | 40 17 416 | A1 | 12/1990 |
| DE | 41 02 166 | A1 | 7/1992 |
| EP | 0 326 451 | | 8/1989 |
| FR | 2 306 888 | | 11/1976 |
| FR | 2 615 822 | | 12/1988 |
| FR | 2 682 936 | | 4/1993 |
| GB | 2 086 352 | A | 5/1982 |
| GB | 2 173 480 | A | 10/1986 |
| GB | 2 188 036 | A | 9/1987 |

* cited by examiner

STACKABLE CORRUGATED BOX

PRIORITY

This application claims priority of CA 2,635,275 filed in Canada on Jun. 18, 2008, the contents of which are incorporated by reference herein.

FIELD OF THE INVENTION

The invention relates to corrugated boxes useful for hoarding and/or transporting goods. More particularly, the invention relates to stackable corrugated boxes where a top of one box is indexable into the bottom of another box.

BACKGROUND OF THE INVENTION

Stackable boxes fabricated in whole or in part from corrugated board, are commonly employed for transporting goods, such as fresh food products and more specifically fruits and vegetables.

Many known stackable boxes used in the field of transportation of food products are made from corrugated blanks having specific designs providing a particular form to the box when erected. For example, commonly used boxes include a base and four walls. The base of such topped-open boxes is provided with openings capable of receiving tabs extending from the walls of another box placed under. Many boxes are also provided with gussets in the corners at the junction between the walls. Other examples of stackable corrugated boxes include inwardly inclined indexing walls, the walls thus forming an angle less than 90° with the base. The presence of inclined walls is not always convenient for stocking the boxes in a minimum of space. Moreover, there is a space loss inside the box limiting the quantity of goods to be stocked.

So, there is still a need for corrugated boxes which are designed for safely and efficiently storing and/or transporting goods, such as fruits and vegetables.

SUMMARY OF THE INVENTION

An object of the present invention is to provide open-topped corrugated boxes which are easily stacked on each other in a safe manner.

Another object of the present invention is to provide corrugated boxes which are easily and rapidly erected.

In accordance with the invention, the above objects are achieved with a stackable corrugated box made of a foldable corrugated blank which comprises a base having a pair of opposed first edges and a pair of opposed second edges and a wall portion extending from each of the opposed first edges of the base. Each of the wall portions comprises two parts, one first part being connected to the base by a first fold line, the second part being connected to the first part, and each of said first and second parts being provided with flaps beyond a fold line extending substantially perpendicular to the first fold line. Moreover, each of the first parts of the wall portion also includes at least two spaced apart crush and knife cut features capable of flexing out positioned along the first fold line. The corrugated blank also comprises a side wall portion extending from each of the second edges of the base which are connected to the second edges by a side fold line. When the corrugated box is erected, the side wall portions are folded perpendicular to the base and are connected via the flaps to upwardly directed walls defined by the first and second parts that have been folded perpendicular to the base. The upwardly directed walls are also provided with at least two projecting tabs. When the corrugated box is stacked on another similar corrugated box, the crush and knife cut features of the first part of the wall portion flex out to allow space for the projecting tabs from the other box placed below.

Other features and advantages of the present invention will be better understood upon reading the following non restrictive description made with reference to the appended drawings.

DETAILED DESCRIPTION OF THE INVENTION

Figure 1:
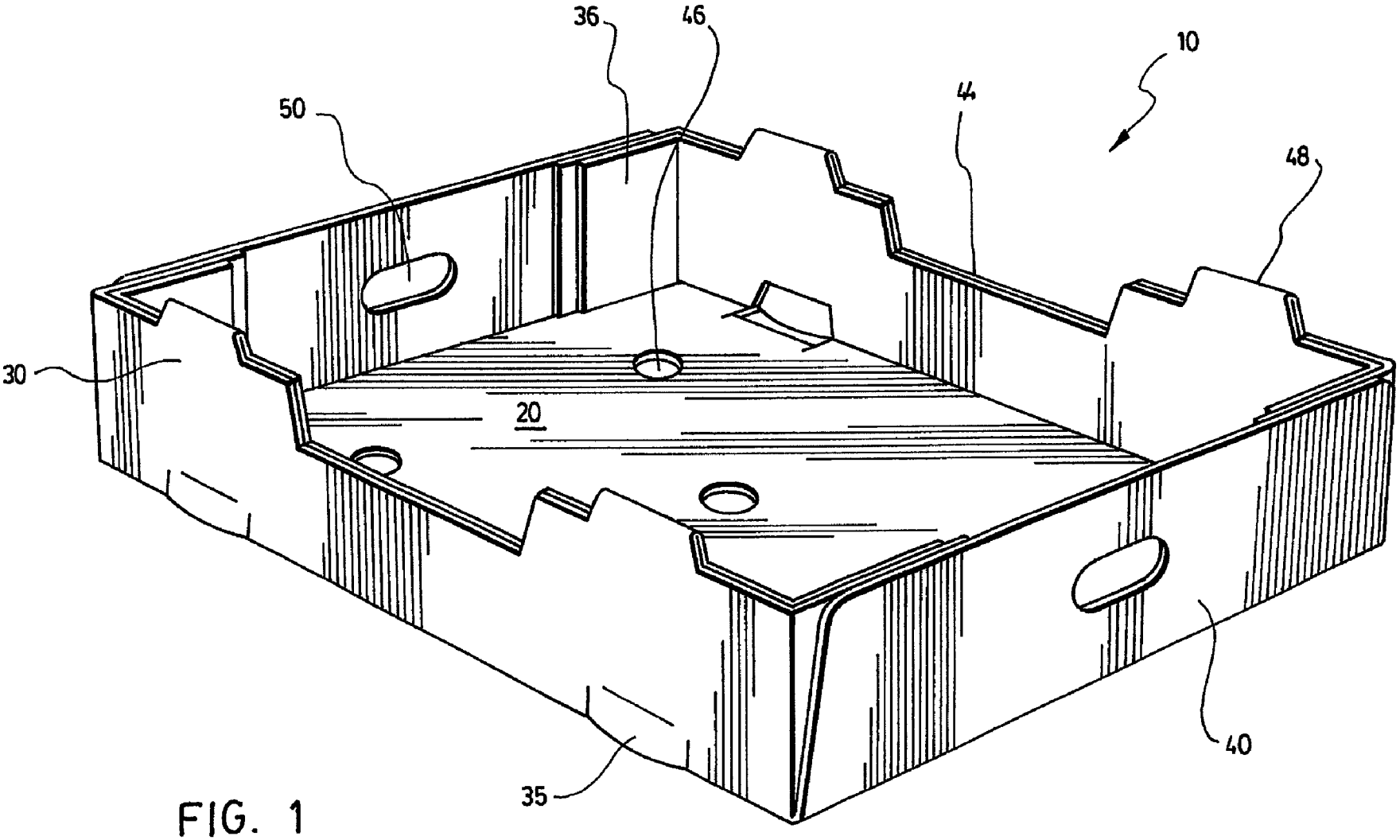
FIG. 1 is a perspective view of a stackable corrugated box according to an embodiment of the invention.

As aforesaid, the present invention is directed to corrugated boxes which have the particularity to be easily stacked on each other and in a safe manner. The corrugated boxes of the invention are made of corrugated blanks which are easy to manufacture and from which the boxes can rapidly be erected.

The stackable corrugated box 10 according to an embodiment of the invention as shown in FIGS. 1 to 7, is made from a pre-cut corrugated blank 12 which is folded in different parts as will be detailed hereinafter.

The foldable corrugated blank 12 comprises a base 20 having a pair of opposed first edges 22 and a pair of opposed second edges 24. In an embodiment, the base 20 is provided with through holes 46 which permit air flowing through the boxes when they are stacked on each other. Such is advantageous when the corrugated boxes are used for stocking and/or transporting fresh food products such as fruits, vegetables, cheese or meat.

The base 20 is usually of a substantial rectangular form. However, if the opposed first and second edges are of the same size, the base is thus square.

The blank 12 also includes wall portions 30 extending from each of the opposed first edges 22 of the base, and a side wall portion 40 extending from each of the second (shorter) edges 24 of the base.

Figure 2:
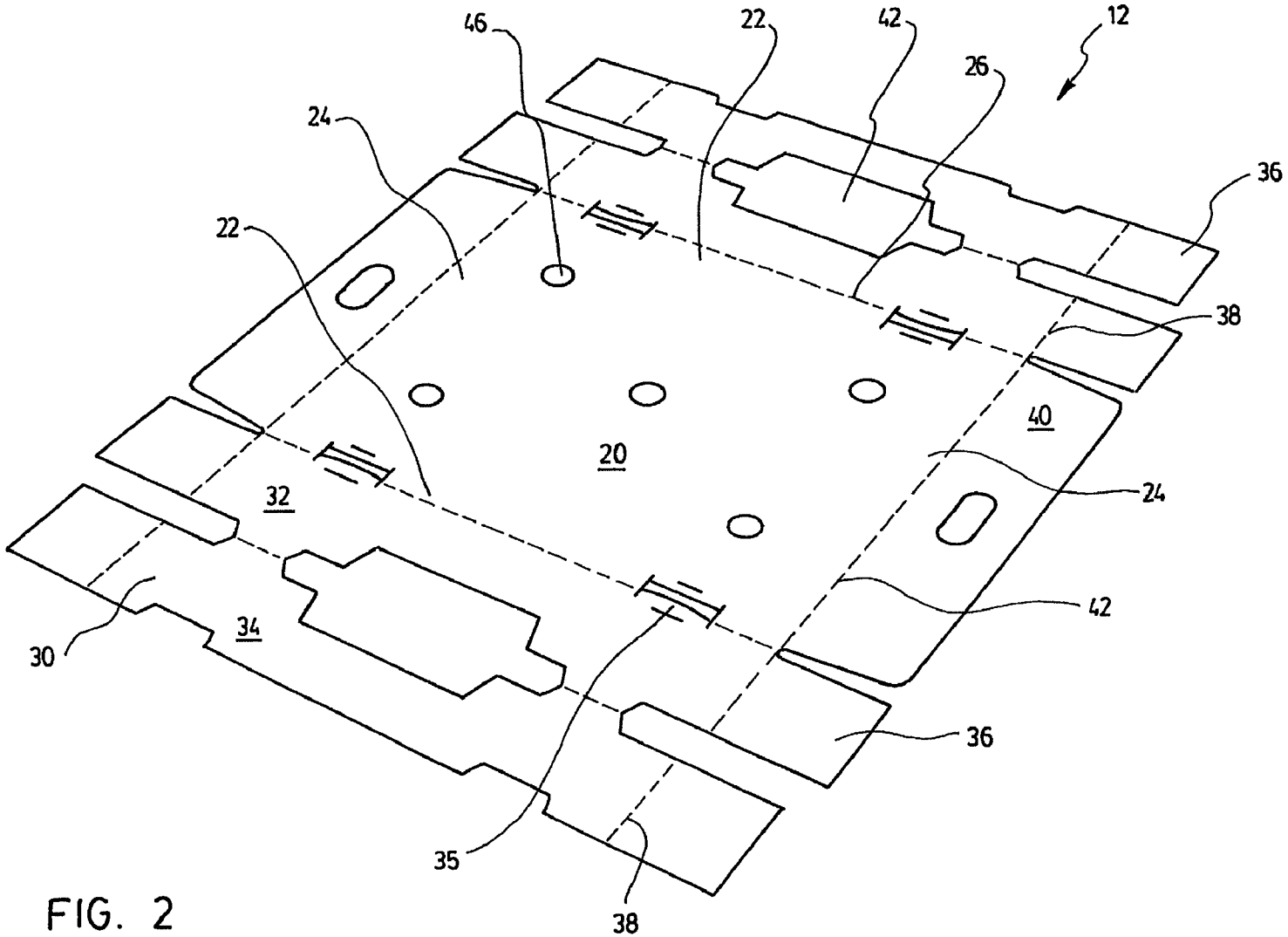
FIG. 2 is a top view of the corrugated blank which is used to form the stackable corrugated box shown in FIG. 1.

Each of the wall portions 30 extending from the longer edges of the base 22 is made of two parts 32 and 34 which are foldable to form upwardly directed walls positioned normal to the base when the box is erected. More particularly, the first part 32 of the wall portion 30 is connected to the base by a first fold line 26. The second part 34 of the wall portion 30 is itself connected to the first part 32 in such a way that the second part is capable to be folded over the first part. As shown in FIGS. 1 and 2, the corrugated blank 12 is also provided with an opening 42 at the junction between the first part 32 and the second part 34 of the wall portion 30. When the box is erected, the second part 34 is folded over the first part 32 and the opening 42 defines a recess 44 which allows air flowing through the boxes when they are stacked on each other. The opening 42 also defines two projecting tabs 48.

The first parts 32 and second parts 34 of the wall portion 30 are also provided with flaps 36 beyond a fold line 38 extending substantially perpendicular to the first fold line 26. As more particularly shown in FIG. 5, these flaps allow connecting the upwardly directed walls to the side wall portions 40. In an embodiment, the flaps 36 are glued to the side wall portions 40.

The corrugated blank also comprises a side wall portion 40 extending from each of the second (shorter) edges 24 of the base 20. Each side wall portion is connected to the shorter edges of the base by a side fold line 42. In an embodiment, the side wall portion can be provided with an opening defining a handle 50 which will allow to hold the corrugated box more safely.

Figure 8:
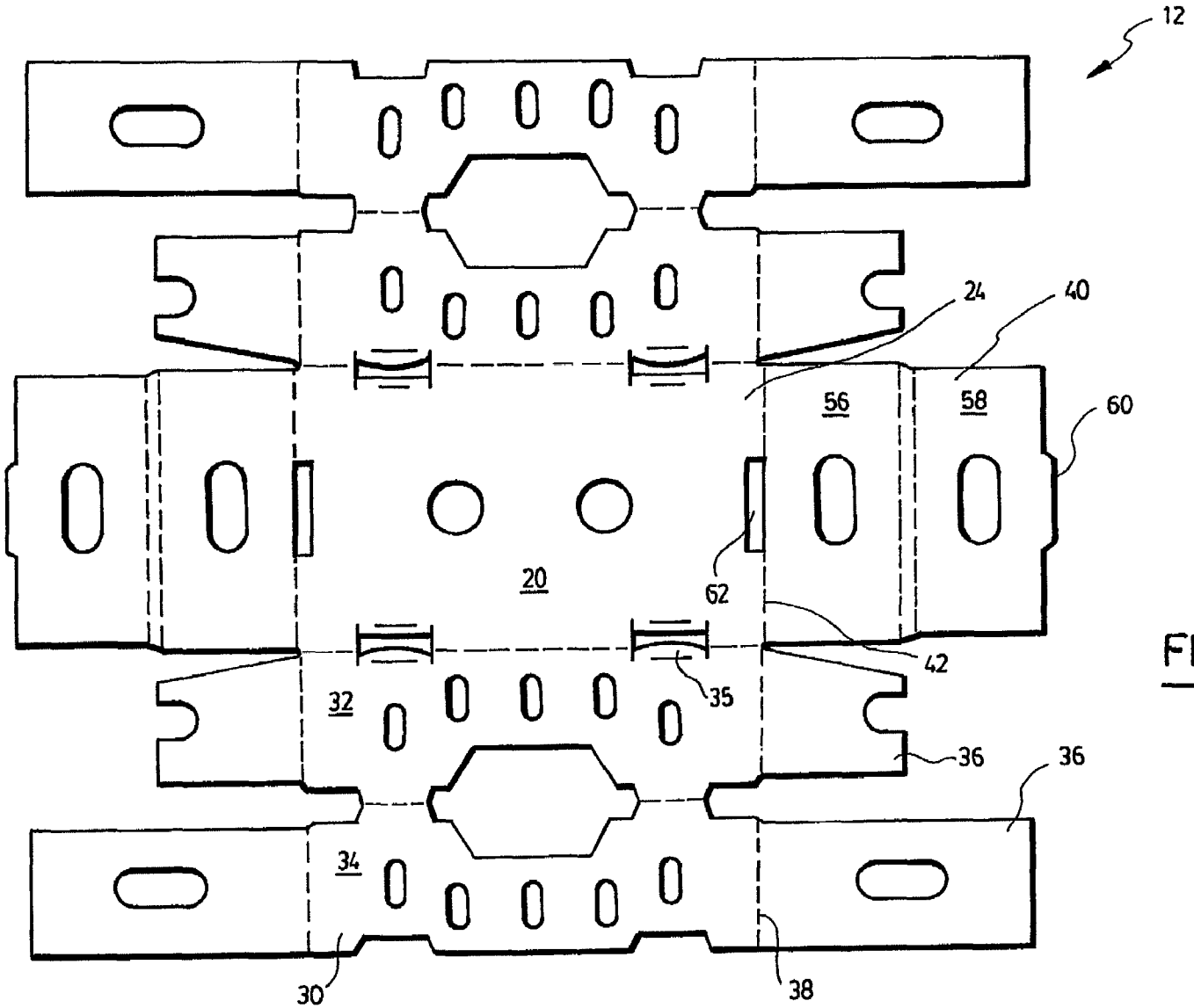
FIG. 8 is a top view of a corrugated blank which is used to form a stackable corrugated box according to another embodiment of the invention.

In an alternate embodiment (see FIG. 8), the side wall portion 40 is made of two foldable panels 56 and 58. When the box is erected, the panel 58 folds over panel 56 while trapping the flaps 36 of the first and second parts of the wall portion 30. In the particular embodiment shown in FIG. 8, the flaps 36 projecting from the second part 34 of the side wall portion 30 are of the same length than the foldable panels 56 and 58. If it is desired that a handle 50 is provided on the side wall portion of the corrugated box, then an opening of the size of the handle 50 is also provided on the flaps 36 projecting from the second part 34 of the side wall portion 30. In the embodiment shown in FIG. 8, the panel 58 is also provided with a lug 60 projecting from its longer outside edge. When the panel 58 folds over panel 56 to form the side wall portion 40, the lug 60 may lock into an opening 62 positioned along the edge 24 of the base 20. In this particular embodiment, no gluing is required.

Figure 7:
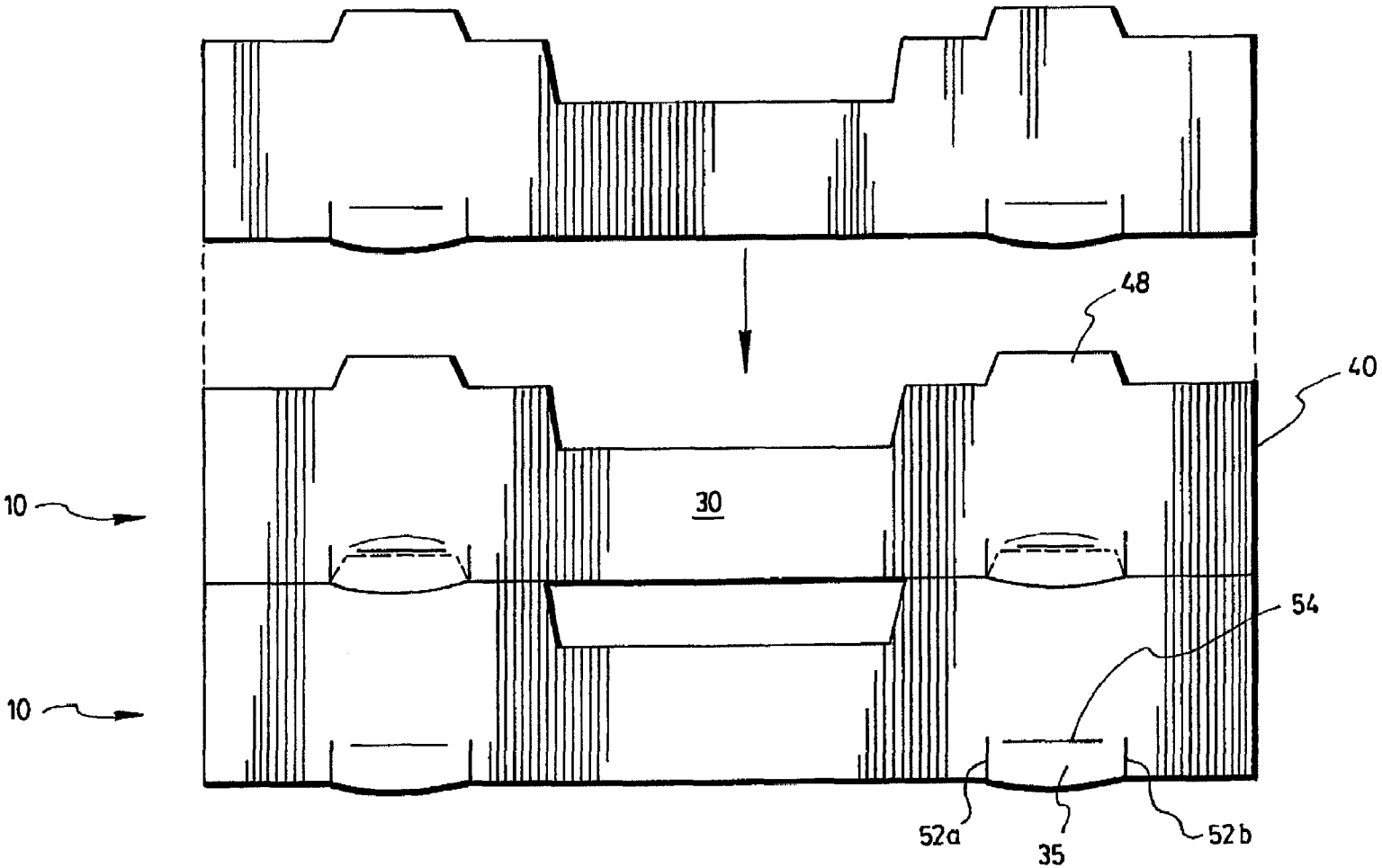

Each of the first parts 32 of the wall portion 30 also includes two spaced apart crush and knife cut features 35 positioned along the first fold line 26. When the corrugated box is stacked above another box, the crush and knife cut features 35 flex out to allow space for the projecting tabs 48 from another box placed below (see FIGS. 6 and 7). As shown in FIG. 7, the crush and knife cut features 35 is generally formed by two vertical cuts 52*a*, 52*b* up from the base 20 of the corrugated box and a horizontal cut 54 positioned between the cuts 52*a*, 52*b* and substantially aligned with the tops thereof. These three cuts form a flap. The size of the feature is determined by the size of the stacking tabs.

In another embodiment, the flap formed by the knife cuts is crushed for example by the cutting die using hard rubber or cork in order to reduce its thickness. This crush thins the material of the flap, then providing a larger space for introduction of the projecting tab 48 from a box below and allowing the flap to bend out more easily.

In a particular embodiment, the base of the flap is cut on a shallow radius. If there is a collision between the flap and the stacking tab, the radius reduces the area of contact allowing the stacking tab to more easily pass by the flap.

In another embodiment, the projecting tabs 48 are also lightly crushed to reduce their thickness thus making it easier for them to fit into the tray above.

The crush and knife cut features configuration allows the sides of the box (the wall portions 30) to be closed in, securely trapping the projecting tabs from the box below while still allowing the sides of the box to be vertical. This avoids the natural conflict that would occur between the closed in side wall of the upper box and the projecting tabs from the box below when the boxes are formed with vertical sides.

Even though the corrugated box according to the embodiment of the invention illustrated in FIG. 1 to 8 includes only two spaced apart crush and knife cut features 35 on each of the first parts 32, and only two projection tabs 48 on the upwardly directed walls, it could also be designed to include more than two of such crush and knife cut features which could allow space for the same number of projecting tabs.

Figure 3:
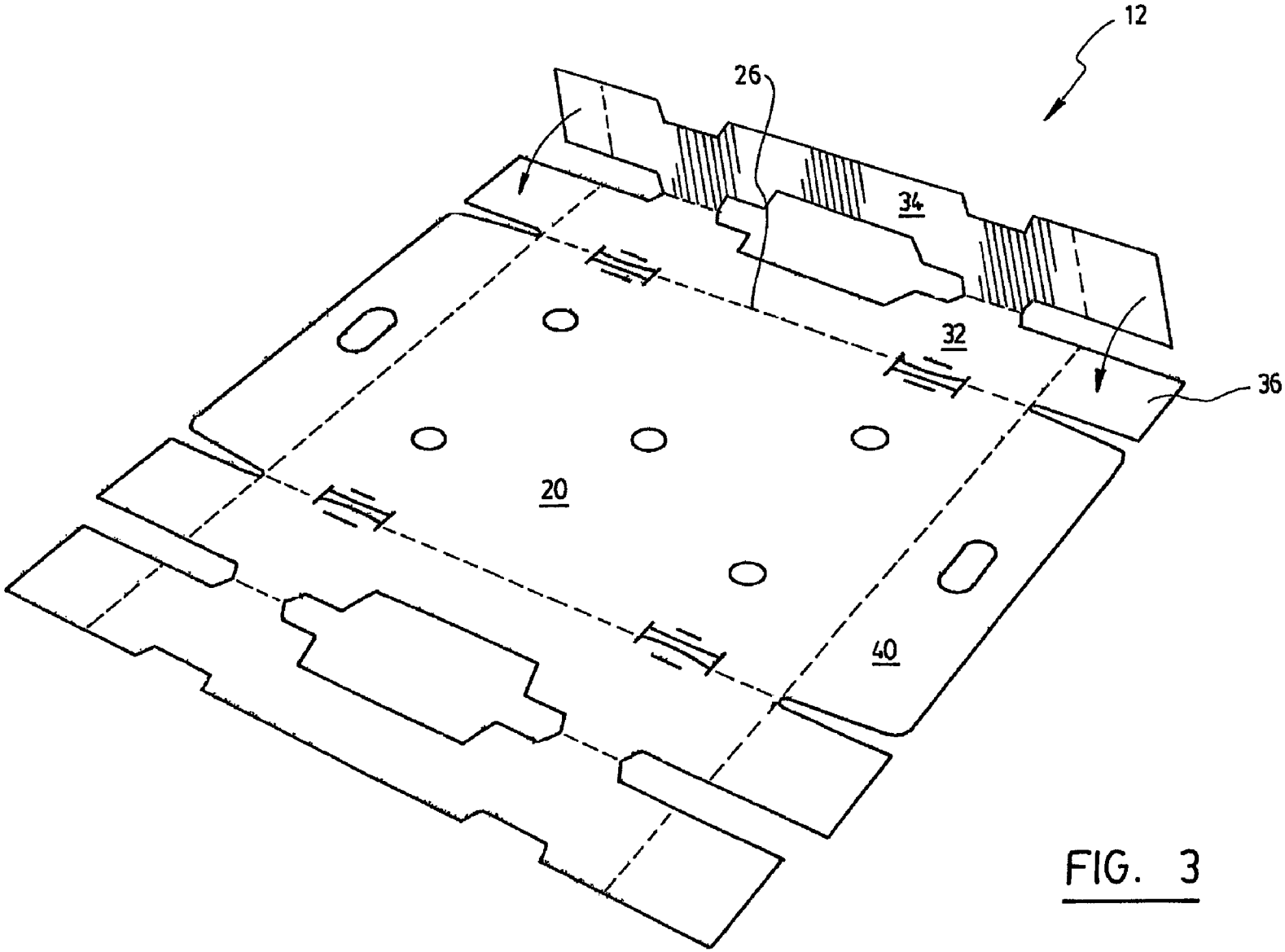
FIGS. 3 to 5 are perspective views showing how the different parts of the corrugated blank shown in FIG. 2 are folded to erect the stackable corrugated box according to the preferred embodiment of the invention.
Figure 4:
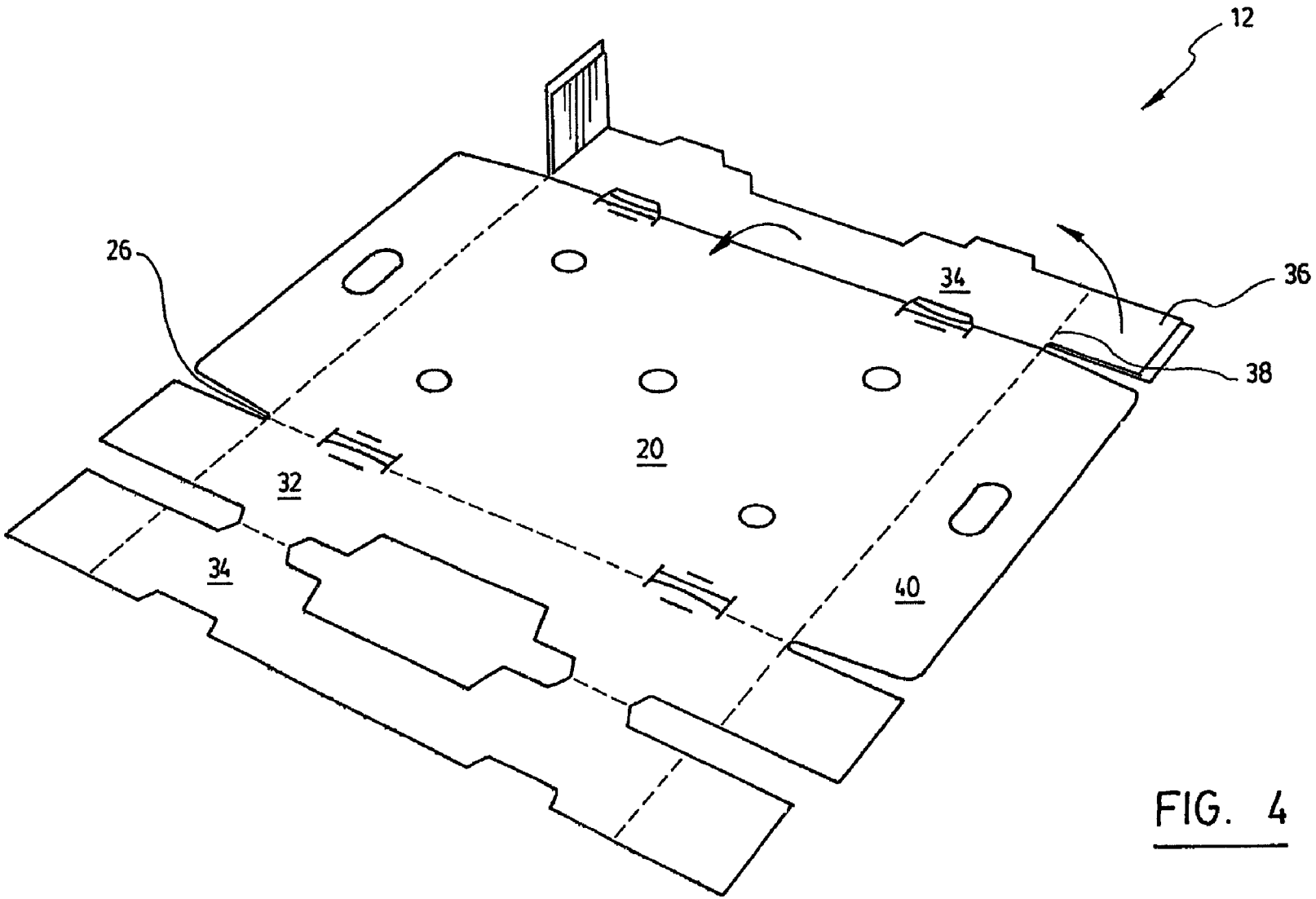
Figure 5:
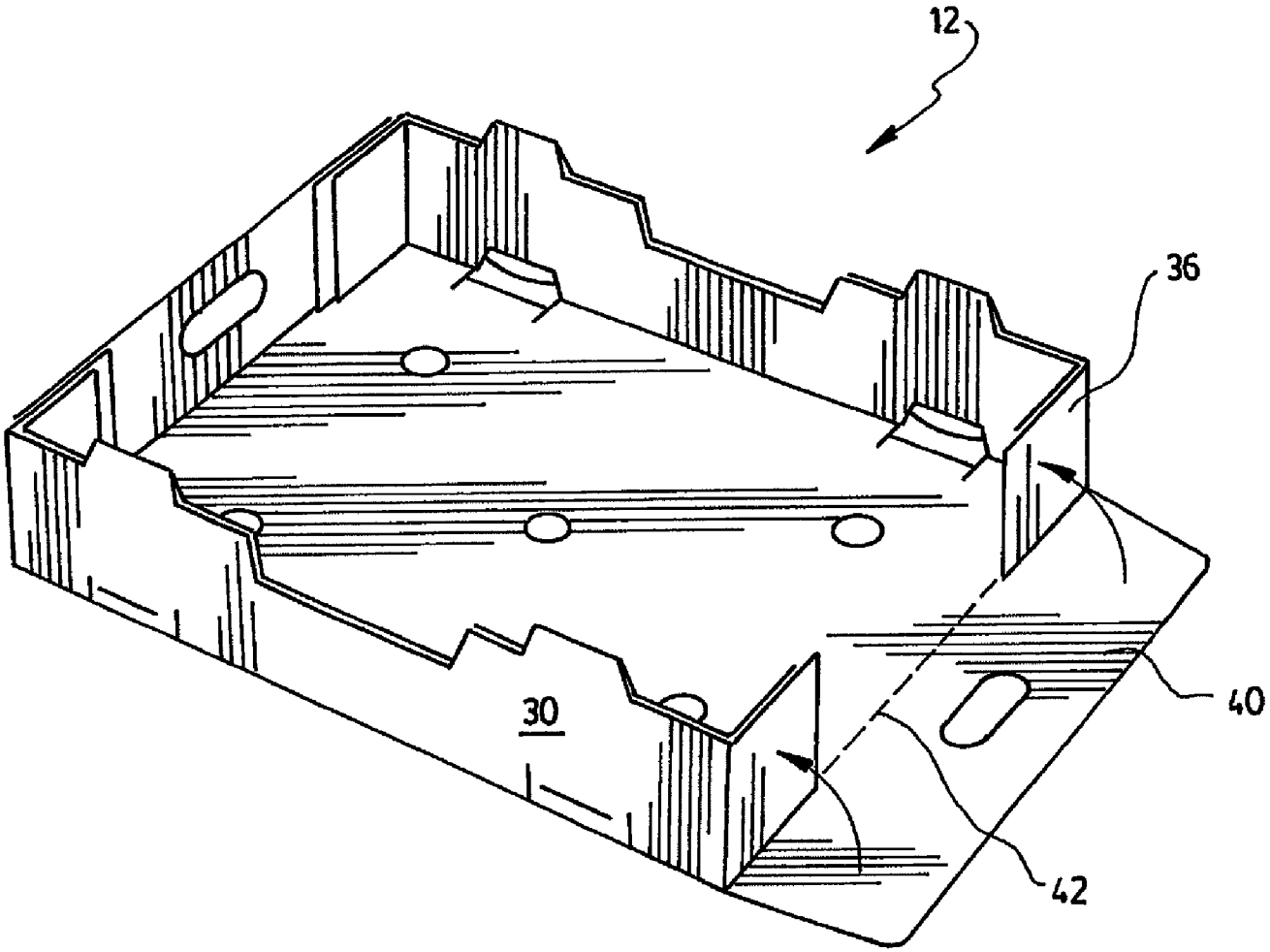
Figure 6:
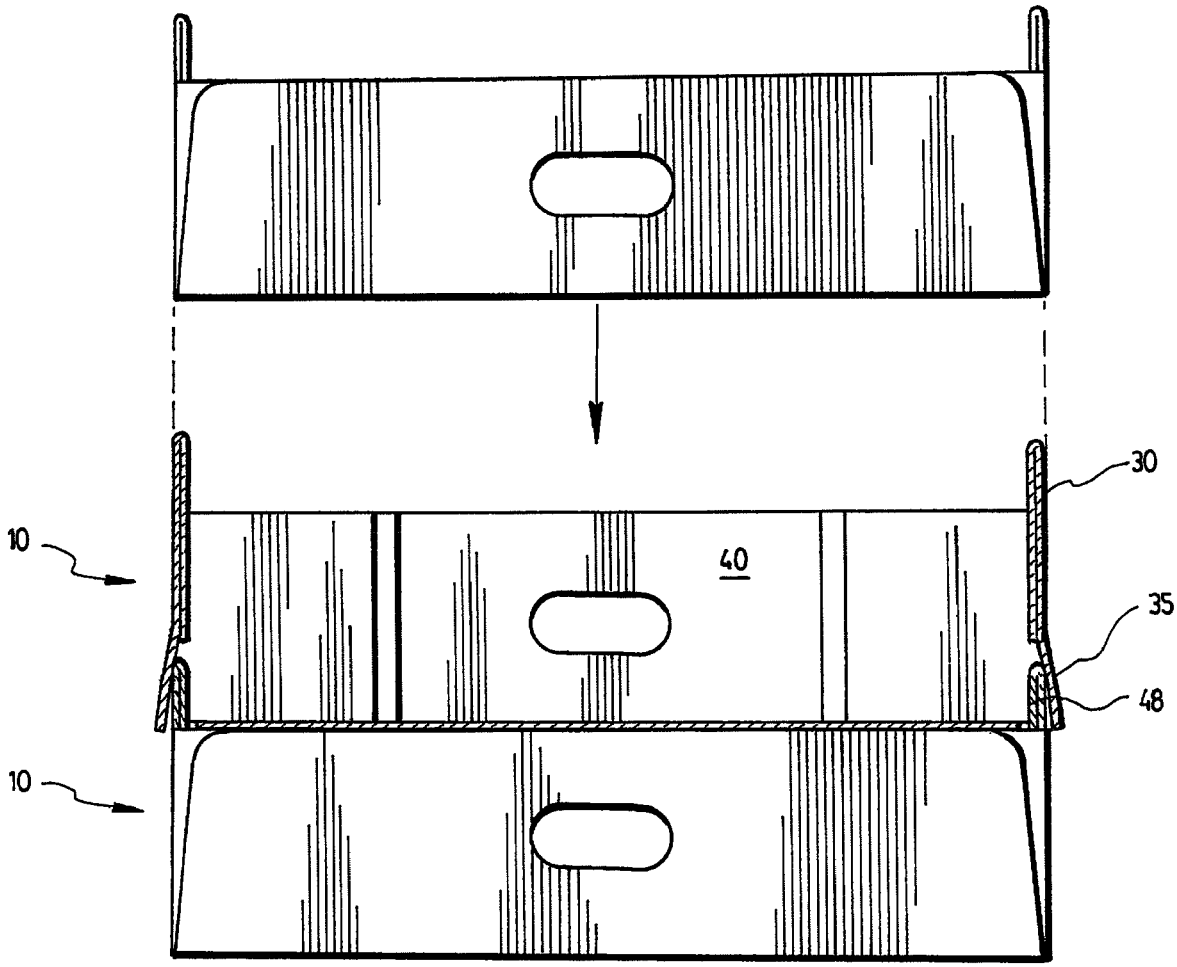
FIGS. 6 and 7 are side views of a plurality of stackable corrugated boxes according to the preferred embodiment of the invention, shown in a stacked position.

FIGS. 3 to 5 show the different steps of folding the corrugated blank 12 in order to build the corrugated box 10. It must be noted that the corrugated box of the present invention may be erected either manually by hand folding or using an automatic manufacturing process. A first step consists of folding up the second part 34 of the wall portion 30 over the first part 32 (FIG. 3). In the following step illustrated in FIG. 4, the flaps 36 of both the first and the second parts are folded up along the fold line 38 and then the wall portion 30 is folded along fold line 26 to form the upwardly directed wall. These two steps may be applied to both wall portions 30 either at the same time or successively. Then, the side walls 40 are folded up along the fold line 42, the extremities thereof leaning against the flaps 36 (FIG. 5). The flaps 36 are then connected to the side walls 40. Once again, the side walls may be either folded one after the other or at the same time, as for example in an automatic manufacturing process.

Of course, numerous modifications could be made to the above-described embodiment without departing from the scope of the invention, as apparent to a person skilled in the art. While specific embodiments of the present invention have been described and illustrated, it will be apparent to those skilled in the art that numerous modifications could be made without departing from the scope of the appended claims.

What is claimed is:

1. A stackable corrugated box made of a foldable corrugated blank, said foldable corrugated blank comprising:

a base having a pair of opposed first edges and a pair of opposed second edges;

a wall portion extending from each of the opposed first edges of the base, each of said wall portions comprising two parts, one first part being connected to the base by a first fold line, the second part being connected to the first part, each of said first and second parts being provided with flaps beyond a fold line extending substantially perpendicular to the first fold line, each of said first parts also including at least two spaced apart crush and knife cut features capable of flexing out positioned along the first fold line, which function as receptacles for stacking tabs, which flex outward, and which capture the stacking tabs on four sides without requiring the sidewalls to slope inward creating a tapered box; and a side wall portion extending from each of the second edges of the base, each sidewall portion connected to a respective second edge by a side fold line, wherein, when the corrugated box is erected, the side wall portions are folded perpendicular to the base and are connected via the flaps to upwardly directed walls defined by the first and second parts that have been folded perpendicular to said base, said upwardly directed walls being provided with at least two projecting tabs, and wherein, when the corrugated box is stacked on another similar corrugated box, the crush and knife cut features of the first part of the wall portion flex out to allow space for the projecting tabs from the other box placed below, and to capture the projecting tab on four sides without requiring the sidewalls to be sloped inward creating a tapered box.

2. The stackable corrugated box of claim 1, wherein each of said upwardly directed walls is provided with a recess extending from an upper edge thereof.

3. The stackable corrugated box of claim 1, wherein each side wall portion comprises a first foldable panel and a second foldable panel, and wherein when the box is erected the second foldable panel folds over the first foldable panel and traps the flaps of the first and second parts of the wall portion.

4. The stackable corrugated box of claim 3, wherein the second foldable panel is provided with a lug projecting from a longer outside edge thereof and wherein when the box is erected, said lug locks into an opening positioned along the second edge of the base when the second foldable panel folds over the first foldable panel to form the side wall portion.

5. The stackable corrugated box of claim 1, wherein the flaps are glued to the side wall portion.

6. The stackable corrugated box of claim 1, wherein the base is rectangular.

7. The stackable corrugated box of claim 1, wherein each of said side wall portions is provided with a through opening defining a handle.

8. The stackable corrugated box of claim 1, wherein the base is provided with a plurality of through holes.

* * * * *